US007651449B1

(12) United States Patent
Balentine

(10) Patent No.: US 7,651,449 B1
(45) Date of Patent: Jan. 26, 2010

(54) DIP STAND

(76) Inventor: Franklin Andral Balentine, 11 Hyannis Dr., Apt. 2C, Asheville, NC (US) 28804-3213

( * ) Notice: Subject to any disclaimer, the term of this patent is extended or adjusted under 35 U.S.C. 154(b) by 29 days.

(21) Appl. No.: 11/716,544

(22) Filed: Mar. 9, 2007

Related U.S. Application Data

(60) Provisional application No. 60/780,430, filed on Mar. 9, 2006.

(51) Int. Cl.
*A63B 1/00* (2006.01)

(52) U.S. Cl. ..... 482/95; 482/141; 248/163.1

(58) Field of Classification Search ..... 248/163.1; 272/62, 63, 93; 135/66, 67; 482/95, 96, 482/141
See application file for complete search history.

(56) References Cited

U.S. PATENT DOCUMENTS 3,572,701 A * 3/1971 Agamian ..... 482/132
4,232,863 A * 11/1980 Roach ..... 482/141
5,096,187 A * 3/1992 Marples ..... 482/41
5,226,868 A * 7/1993 Montgomery ..... 482/141
5,947,307 A * 9/1999 Battaglia et al. ..... 211/187
D525,668 S * 7/2006 Payne ..... D21/691
7,367,928 B2 * 5/2008 Storch ..... 482/141

* cited by examiner

*Primary Examiner*—Amy J Sterling
*Assistant Examiner*—Steven M Marsh
(74) *Attorney, Agent, or Firm*—Carter, Schnedler & Warnock, P.A.

(57) ABSTRACT

A dip stand intended for use as a home strength training machine to perform dips such as chest dips and tricep dips. The stand is made of rigid tubing formed as a continuous loop. The loop includes a pair of generally parallel base segments to be supported on a floor surface, each of the base segments having a first end and a second end; and a pair of arches extending upwardly from the base segments, one of the arches extending upwardly from the first ends of the base segments and the other of the arches extending upwardly from the second ends of the base segments. Each of the arches includes an upper generally horizontal grip segment.

2 Claims, 3 Drawing Sheets

DIP STAND

CROSS-REFERENCE TO RELATED APPLICATION

The benefit of U.S. provisional patent application Ser. No. 60/780,430, filed Mar. 9, 2006 is claimed.

BACKGROUND OF THE INVENTION

The invention relates generally to strength training equipment and, more particularly, to dip bars.

SUMMARY OF THE INVENTION

In one aspect, a dip stand is provided comprising rigid tubing formed as a continuous loop. The loop includes a pair of generally parallel base segments to be supported on a floor surface, each of the base segments having a first end and a second end; and a pair of arches extending upwardly from the base segments, one of the arches extending upwardly from the first ends of the base segments and the other of the arches extending upwardly from the second ends of the base segments. Each of the arches includes an upper generally horizontal grip segment.

DETAILED DESCRIPTION

Figure 1:
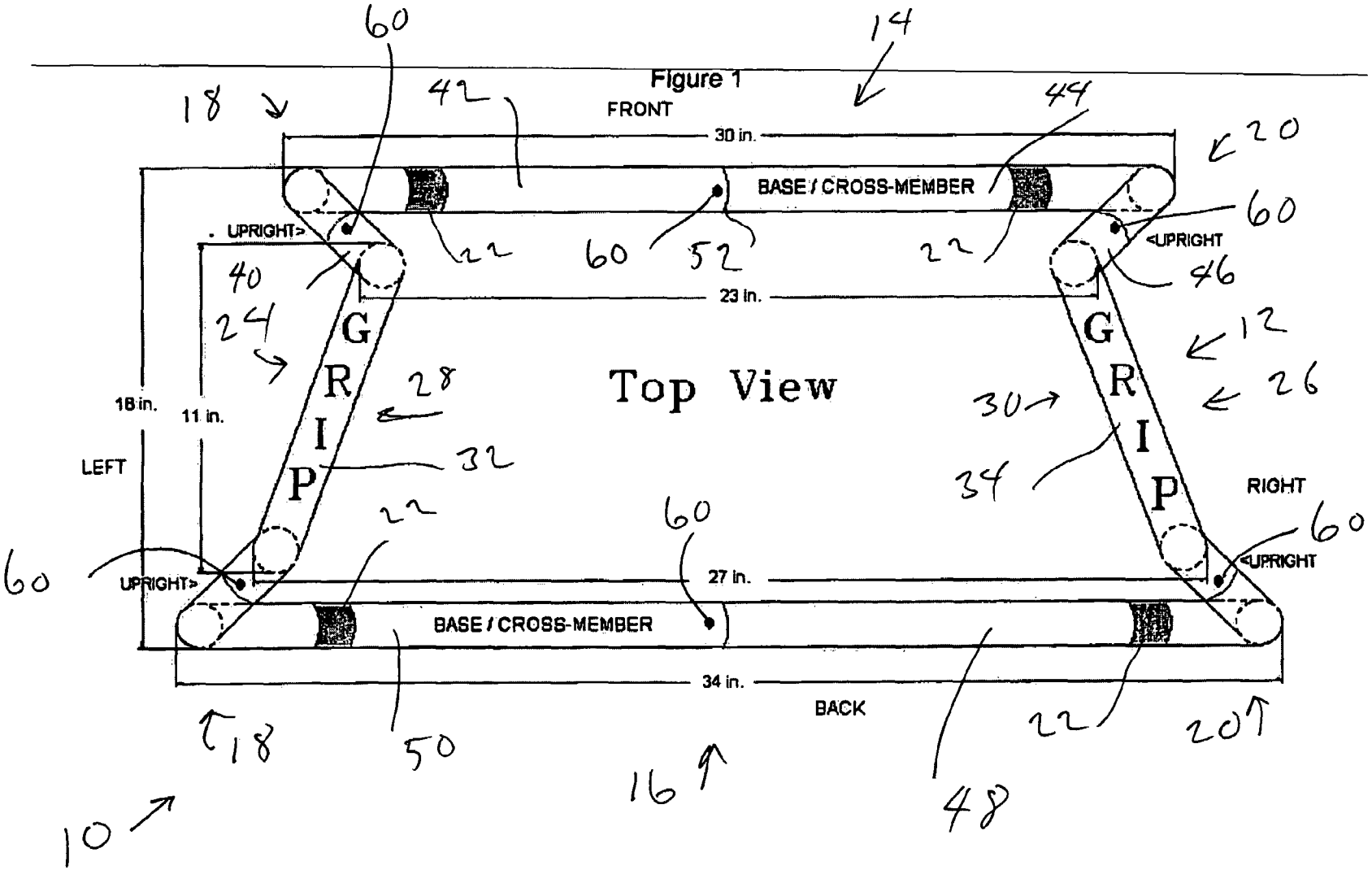
FIG. 1 is a top elevational view of a dip stand embodying the invention.
Figure 3:
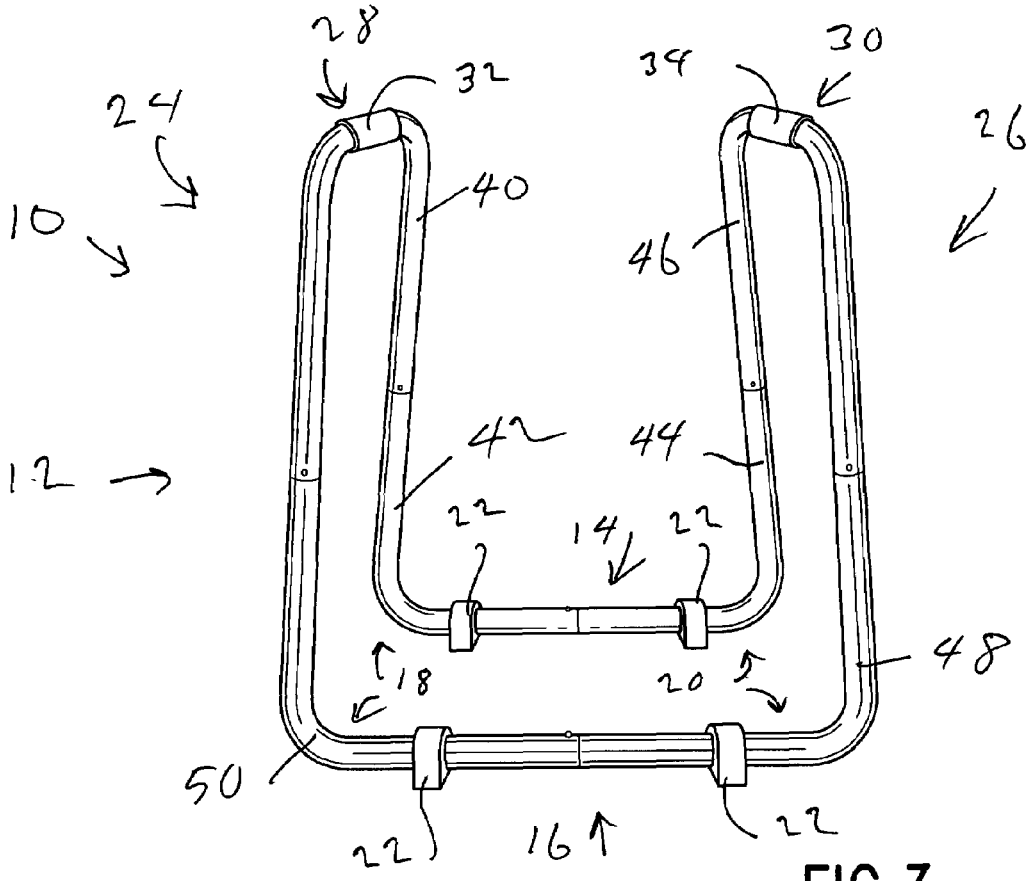
FIG. 3 is a three-dimensional view, generally from the rear, of the dip stand of FIG. 1.
Figure 4:
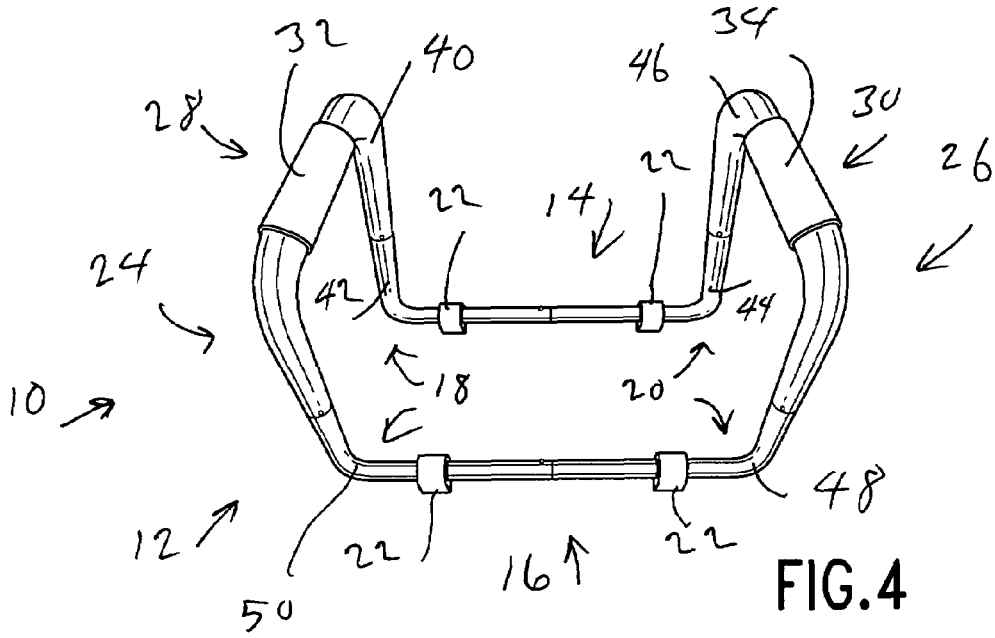
FIG. 4 is a three-dimensional view, generally from the rear, of the dip stand.

With reference to FIGS. 1, 3 and 4, an exercise apparatus in the form of a dip stand 10 is intended for use as a home strength training machine to perform conventional dips such as chest dips and tricep dips. The dip stand 10 may also be referred to as a dip bar 10. The dip stand 10 is made of rigid tubing, such as 16-gauge, 1.5 inch diameter steel tubing, formed as a continuous loop 12. All bends have a three-inch radius.

The continuous loop 12 includes a pair of generally parallel base segments 14 and 16 which are intended to be supported on a floor surface. Each of the base segments 14 and 16 has a first end 18 and a second end 20. Sleeve-like rubber feet 22 are fitted over the base segments 14 and 16, and provide cushioning. Although not so illustrated, to provide micro-leveling capability for greater stability, the feet 22 may be octagonal to provide flat surfaces, with a center aperture which is offset from center.

The generally parallel base segments 14 and 16 are spaced approximately eighteen inches from each other. The base segment 14 may be referred to as the "front" base segment, and is thirty inches long. The base segment 16 may be referred to as the "rear" base segment, and is thirty-four inches long in the illustrated embodiment. Thus, the "front" base segment 14 is accordingly shorter than the "rear" base segment 16.

The continuous loop 12 additionally includes a pair of arches 24 and 26 extending upwardly from the base segments 14 and 16. One arch 24 extends upwardly from the first ends 18 of the base segments 14 and 16, and the other arch 26 extends upwardly from the second ends 20 of the base segments 14 and 16. The arches 24 and 26 include respective upper generally horizontal grip segments 28 and 30, which, in the illustrated embodiment, are thirty-six inches above the base segments 14 and 16, thus defining the overall height of the dip stand 10. The grip segments 28 and 30 are eleven inches in length, and are parallel to the floor. Sleeve-like cushioned grip material 32 and 34 is provided over the actual grip segments 28 and 30.

Due to the unequal lengths of the front and rear base segments 14 and 16, the grip segments 28 and 30 are offset from being parallel to each other. Stated in other words, the arches 24 and 26 rise at nearly parallel angles from the parallel base segments 14 and 16, but the arches 24 and 26 are not exactly parallel to each other.

To facilitate manufacture and shipping in a compact package, the continuous loop 12 is made of six individual pieces or sections 40, 42, 44, 46, 48 and 50, which are coupled together at joints, such as exemplary joint 52.

Figure 2:
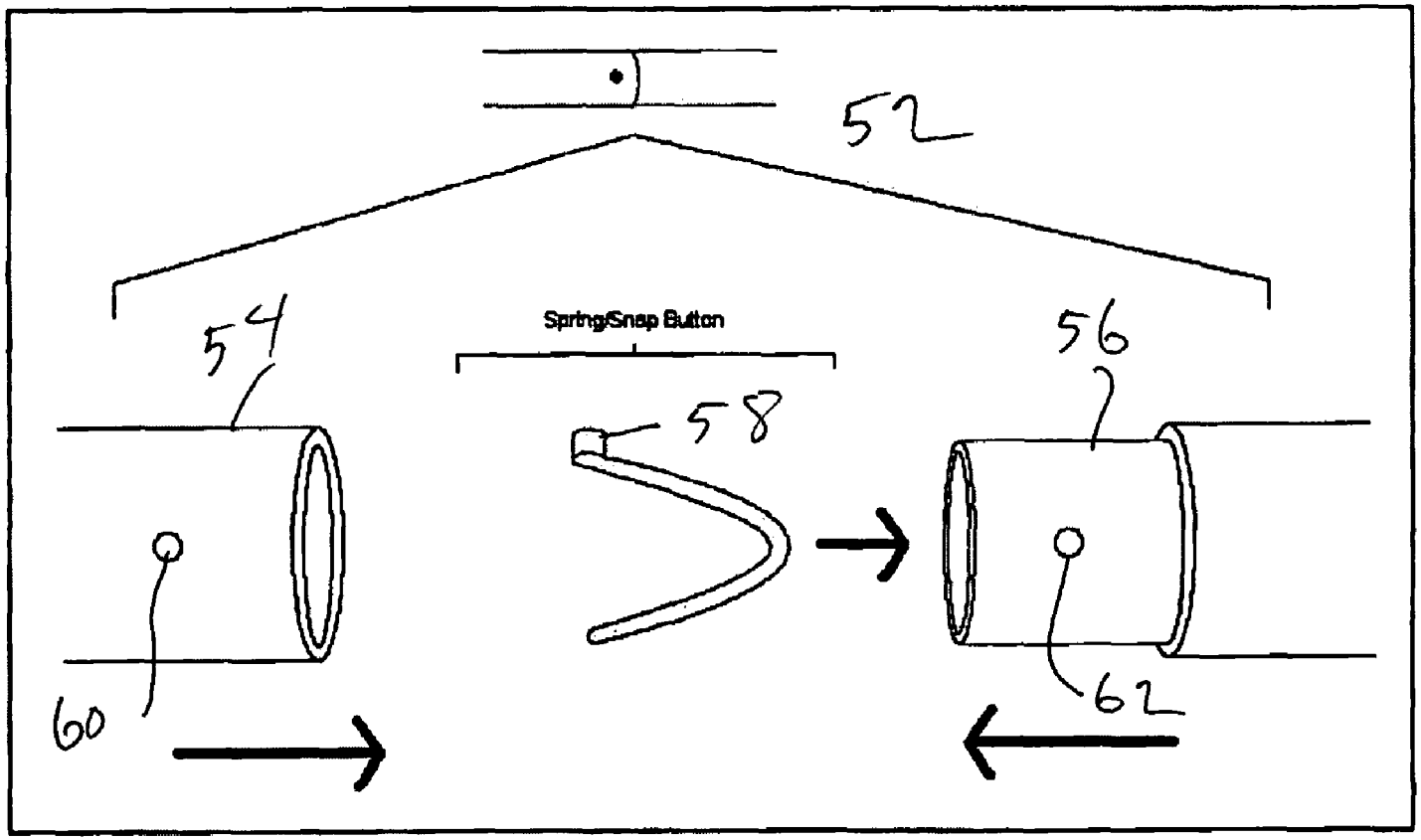
FIG. 2 illustrates the manner in which individual tubing sections are joined.

With particular reference to FIG. 2, end portions 54 and 56 of two sections to be coupled are joined together employing a snap spring button 58 which engages aligned apertures 60 and 62 in the tubing end portions 54 and 56. The end portion 56 is swaged, so as to telescope into the other tubing end portion 54. The six pieces or sections 40, 42, 44, 46, 48 and 50 are thus joined together to form the continuous loop 12.

In view of the foregoing, it will be appreciated that embodiments of the invention provide a dip stand 10 which takes up a minimal amount of space (for shipping and use), while providing a dip stand 10 with the strength needed to support the human body in performing the traditional chest/tricep dip exercise motion. For performing a chest dip, a user stands between the base segments 14 and 16, facing either the "front" base segment 14 or the "rear" base segment 16, with hands out to the side on the horizontal grip segments 28 and 30. To perform a chest dip, ordinarily the user faces the narrower "front" base segment 14 so that the grip segments 28 and 30 narrow. For a tricep dip, the user faces in the other direction, facing the wider "rear" base segment 16, so that the grip segments 28 and 30 widen.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A dip stand comprising:

rigid tubing formed as a continuous loop, said loop including a pair of generally parallel base segments to be supported on a floor surface, each of said base segments having a first end and a second end, and a pair of arches extending upwardly from said base segments, one of said arches extending upwardly from said first ends of said base segments and the other of said arches extending upwardly from said second ends of said base segments, and each of said arches including an upper generally horizontal grip segment, said upper generally horizontal grip segments being thirty-six inches above said base segments such that said dip stand has sufficient height to function as a dip stand;

said base segments being of unequal lengths, and said arches and grip segments being offset from being parallel to each other.

2. The dip stand of claim 1, wherein said continuous loop comprises individual sections which are assembled together.

* * * * *